US005167003A

United States Patent [19]

Montanari et al.

[11] Patent Number: 5,167,003

[45] Date of Patent: Nov. 24, 1992

[54] SCANNING INFRARED FOR CLEANING LAMP HEATER A FOOD PREPARATION OVEN BY PYROLYSIS

[75] Inventors: Carlo Montanari, Milan; Giovanni Franzetti, Ispra, both of Italy

[73] Assignee: Whirlpool International B.V., Eindhoven, Netherlands

[21] Appl. No.: 731,674

[22] Filed: Jul. 17, 1991

[30] Foreign Application Priority Data

Jul. 24, 1990 [IT] Italy ..... 21030 A/90

[51] Int. Cl.[5] ..... F26B 19/00; A21B 2/00

[52] U.S. Cl. ..... 392/416; 392/419; 219/405; 219/411; 126/19 R; 126/273 R; 134/1; 99/451

[58] Field of Search ..... 392/416, 419, 421, 440, 392/417; 362/92, 89, 91, 277, 282, 284; 219/404, 405, 411; 126/273 R, 19 R, 275 E; 134/1; 99/451

[56] References Cited

U.S. PATENT DOCUMENTS 3,302,000 1/1967 Sherman ..... 126/19 R
3,518,981 7/1970 Darrow et al. ..... 126/273 R
4,444,146 4/1984 De Witz et al. ..... 134/1
4,728,777 3/1988 Tsisios et al. ..... 219/405

FOREIGN PATENT DOCUMENTS 3718823 12/1988 Fed. Rep. of Germany .... 126/19 R
2205484 12/1988 United Kingdom .

*Primary Examiner*—Teresa J. Walberg
*Assistant Examiner*—John A. Jeffery
*Attorney, Agent, or Firm*—Thomas J. Roth; Stephen D. Krefman; Thomas E. Turcotte

[57] ABSTRACT

A food preparation oven includes a cooking chamber (1) in which a device (12) is provided for generating heat waves and for directing them in a suitably concentrated manner onto the surfaces (6, 7, 8, 9, 10,11) of the walls of the chamber (1); the device (12) is removably arranged in the cooking chamber (1) and is mobile therein so as to direct the heat waves onto the entire surface of the walls, the concentrated waves scanning the surfaces (6, 7, 8, 9, 10, 11) but covering only portions of them at any given time, creating only in and around these portions a high temperature which results in the pyrolysis of the impurities which have been deposited on the surfaces (6, 7, 8, 9, 10, 11) during the use of the oven. The heat waves can also be used for food preparation.

22 Claims, 3 Drawing Sheets

SCANNING INFRARED FOR CLEANING LAMP HEATER A FOOD PREPARATION OVEN BY PYROLYSIS

BACKGROUND OF THE INVENTION

This invention relates to an oven of any type, ie gas, microwave, electric, combination etc., provided with a cooking chamber for food preparation.

The problem of cleaning deposits, particularly fats from the cooking chamber walls following use of the oven is well known. This cleaning can be done in various ways, either manually or more particularly by the pyrolysis of such impurities. With reference to the latter method of cleaning the oven cooking chamber, pyrolysis is achieved by arranging electrical resistance elements at the walls of said chamber to heat the surfaces of said walls (on which said impurities have deposited) to a temperature of around 500° C. or more.

Pyrolysis effected in this manner has various drawbacks. One of these is the arranging of the resistance elements along the cooking chamber walls, resulting in a higher oven coat, greater difficulties in its construction due to the need to better insulate its walls (for example to prevent them reaching temperatures which are too high and thus dangerous for the user) and greater energy consumption due to the use of such resistance elements. In addition the pyrolysis is achieved by unselectively heating the entire inner surfaces of the cooking chamber walls, even in regions in which this heating is unnecessary, with further energy wastage.

A further drawback is that as a consequence of the generalized heating of the inner surfaces of the cooking chamber, very high cooling time is needed, which makes it impossible to use the oven for a long time after it has been cleaned by pyrolysis.

SUMMARY OF THE INVENTION

An object of the present invention is to provide an oven which can be cleaned by pyrolysis without the aforesaid drawbacks.

A particular object is to provide an oven in which said pyrolysis can be achieved without arranging resistance elements in positions corresponding with the cooking chamber walls.

A further object is to provide an oven of the aforesaid type which can be used soon after it has been cleaned by pyrolysis.

A further object is to provide an oven in which said means for effecting pyrolysis on the inner surface of the cooking chamber can be used for food preparation.

A further object is to provide an oven with a pyrolysis-cleanable cooking chamber which is of smaller weight and dimensions than prior art ovens.

These and further objects will be apparent to one skilled in the art are attained by a food preparation oven including a cooking chamber, having means for generating heat waves and for directing them in a suitably concentrated manner onto the inner surfaces of the walls of the cooking chamber, said means being removable arranged in the cooking chamber and being mobile therein so as to direct the heat waves onto the entire surface of each of the walls concentrated waves scanning the surfaces in such a manner as to create a high temperature thereon which results in the pyrolysis of the impurities which have been deposited on said surfaces during the use of the oven.

DESCRIPTION OF THE PREFERRED EMBODIMENTS

Figure 1:
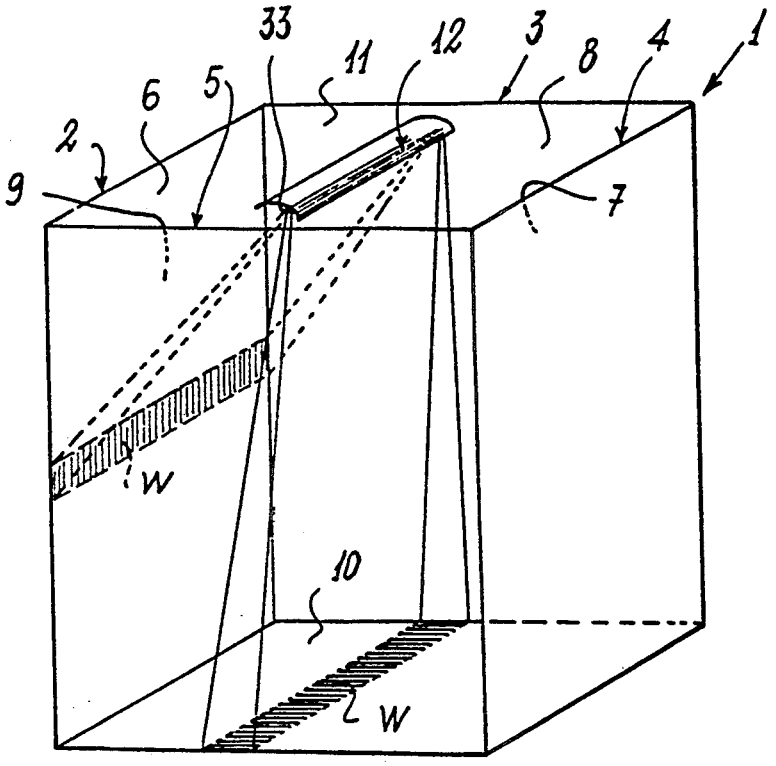
FIG. 1 is a schematic transparent perspective view of a cooking chamber in an oven constructed in accordance with the present invention.
Figure 2:
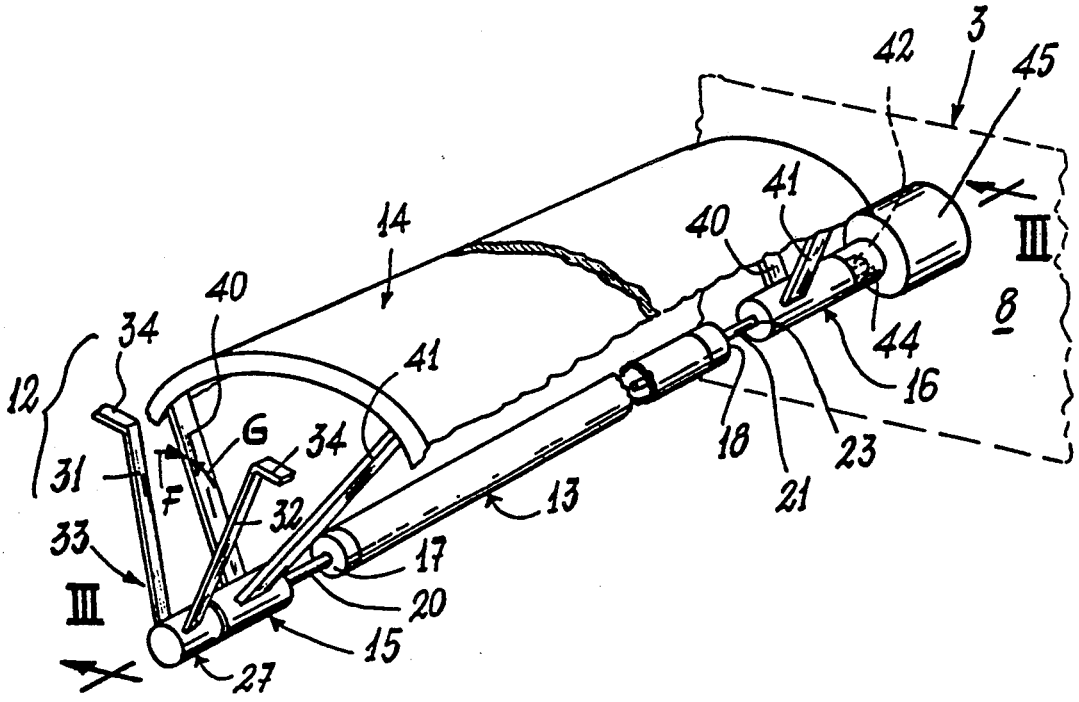
FIG. 2 is a perspective view of a part of the oven according to the invention.
Figure 3:
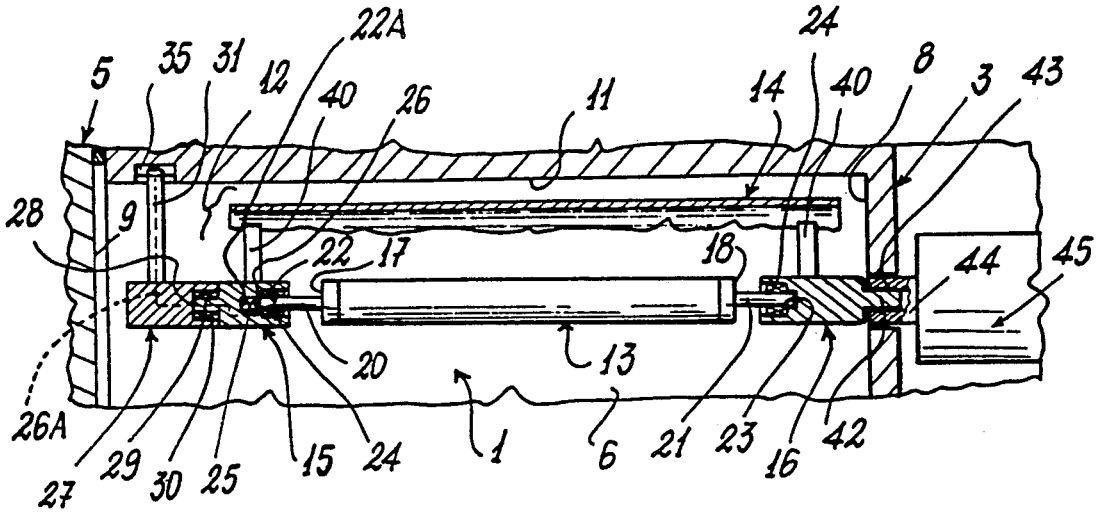
FIG. 3 is a section on the line III—III of FIG. 2.

As shown in FIGS. 1 to 3, the oven according to the invention comprises a cooking chamber 1 provided with walls 2, 3, 4 and 5. Said walls define and delimit the inner surfaces of the chamber 1, namely two lateral surfaces 6 and 7, an end surface 8, a front surface 9, a base surface 10 and a roof 11.

Located within cooking chamber 1 is a device 12 which can be removable inserted into the chamber to enable the inner surfaces 6, 7, 9, 10 and 11 of said chamber to be cleaned by pyrolysis.

In an embodiment shown in the accompanying figures said device is arranged in a position corresponding with the roof 11 of the chamber 1, and has as an element 13 arranged to generate a light beam, said element preferably being a halogen lamp, and a reflector element 14 positioned to correspond with the light element or lamp 13.

The lamp 13 is positioned by members 15 and 16 positioned at the opposing ends of the lamp 13 and which also support the reflector element 14.

Specifically, from the ends 17 and 18 of the lamp 13 there extend respectively two pins 20 and 21 which are arrange to cooperate with corresponding apertures or blind holes 22 and 23 in the members 15 and 16. In these apertures there are inserted usual bearings 24 or other mechanical decoupling members allowing relative movement between the parts and able to support said pins 20 and 21, and to allow the reflector element 14 to move relative to the lamp 13 in the described embodiment.

In the aperture 22 there is inserted an elastic element (compression spring) 25 which acts at one end against the end 22A of the aperture 22 and at its free end carries a usual electrical contact element to enable electrical power to be fed to the lamp 13. The contact element 26 is connected to electrical connectors (not shown) which are connected to a power line (not shown) present in the oven under consideration, via an end support element 27 to which the member 15 is connected, and via the member 15 itself.

Additionally end projecting part 28 cooperates with an aperture 29 in the support member 27, in which bearings 30 are provided.

The projecting part 28 carries electrical contacts (male) of the quick connection type (for example of plug-in type) cooperating with corresponding counter-contacts (female) connected to electrical cables passing through at least one of two arms 31, 32 which extend from the member 27 to support at one of its ends 33 the device 12.

The arms 31, 32 are elastically deformable (arrows F and G in FIG. 2) and have bent ends 34 which cooperative with seats 35 provided in the roof 11 of the chamber 1.

At the end of at least one of said arms 31, 32 there are provided electrical connectors (not shown) which are connected to the cables passing through the arms for connection, for example by plugging in, to corresponding contacts (not shown) provided in the seats 35.

It should be noted that the connection for the electrical power to the lamp 13 is shown (see FIG. 3) only schematically, as a dashed straight line 26A in said figure.

The reflector element 14 is supported and kept at a short distance from the lamp 13 by arms 40 and 41 fixed to said members 15 and 16.

Member 16 is close to the wall 3 of chamber 1 and includes a projection 42 directed towards the end surface 8 of said chamber. In the illustrated example, the projection 42 is of square cross-section and is arranged to cooperate with a corresponding hole 43 provided in the output shaft 44 of an electric motor 45.

This electric motor 45 is advantageously of the stepping type and rotationally moves the reflector element 14 about the lamp 13. This movement is therefor discrete and comprises an alternation of time periods in which the element 14 rotates about the lamp and periods in which the element is at rest.

The rotation takes place each time through a very few degrees, the time of which the element 14 remains at rest (halt time) being sufficient to enable alight beam emitted by the lamp 13 to effect pyrolysis on the walls of the chamber 1.

To clean the oven, device 12 is inserted into the chamber 1. During insertion the projection 42 on the member 16 is positioned so that it fits into the shaft 44 of the motor 45. Having done this, the arms 31 and 32 are forced together in accordance with the arrows F and G of FIG. 2 and their free ends are inserted into the seats 35 present in the roof 11 of said chamber.

At this point the device 12 has been inserted into the cooking chamber 1 and can be used for pyrolysis of the impurities deposited on the inner surfaces of said cooking chamber 1 during food preparation.

Figure 4:
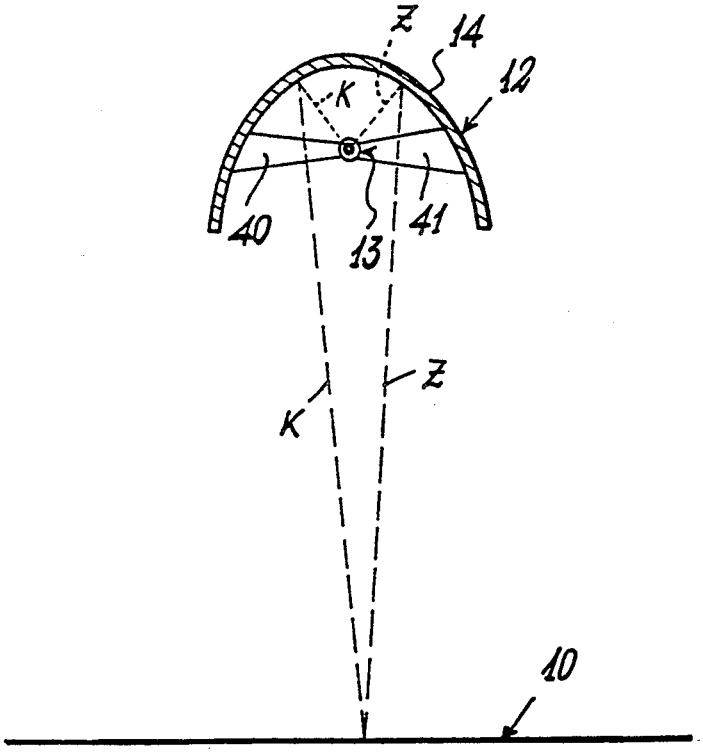
FIGS. 4 and 5 are cross-sectional schematic views of two different embodiments of the part shown in FIG. 2.

By operating a suitable actuator element (such as a pushbutton on the front of the oven), the motor 45 is operated. At the same time (if this is not done directly by operating said pushbutton) the lamp 13 is lit by a suitable pushbutton again in a suitable position on the outside of the oven (for example on the front). Following this, the element 14 begins to rotate about the lamp 13 (which remains fixed), the light beam emitted by the lamp being reflected by said element and suitably concentrated thereby. An example of how this happens is shown FIG. 4. In this figure the reflector element 14 (which is also able to concentrate the light beam onto an inner surface of the cooking chamber ) consists of a paraboloid.

In this figure, the light beam is by way of example fed in the form of a line (or very narrow band) of light onto the base 10 of the chamber 1. This beam is defined by the end rays K and Z.

The rays are emitted specifically by a lamp 13 screened lowerly by a reflecting film associated with its outer casing. The rays K and Z are therefore directed towards the element or paraboloid 14 and are reflected and concentrated by this onto said base 10. In contrast, in FIG. 1 the emitted light beam defines on the wall 10 a light band W which also moves along the lateral walls 6 and 7 (in which it is shown in hatching on the wall 6). With the discrete movement of the element 14, the band W (or the line of FIG. 4) moves along said walls and after each individual movement stops for a suitable time during which the temperature of the surface portion covered by the light beam reaches a temperature close to or exceeding 500° C.

This temperature results in pyrolysis of the impurities present on that portion.

It should be noted that the temperature is reached in the region covered by the light beam (or rather the band W) and in the adjoining regions. However the more distant regions are not subjected to high temperature heating and this enables them to cool rapidly (possibly aided by circulation of air grazing the surfaces of the walls of the chamber 2).

In the described embodiment shown in FIGS. 1 to 4 the device 12 enables pyrolysis to be effected particularly over the surfaces 6, 7, 10 of the walls of the cooking chamber 1. However particular forms of the reflector element 14 can be provided as can particular positions of the device 12 within the cooking chamber (such as in the "spit-roasting" position) so that simultaneously with the rotation of the element 14, with or without joint rotation of the lamp 13, the light beam strikes all surfaces of the walls of said chamber. In this manner pyrolysis on all said surfaces is obtained by a single "stepwise" rotation.

As described herein, the element 12 must be moved from the position shown for example in FIG. 1 to a second position substantially perpendicular to this latter. When in this second position the device 12 is again "activated" to also achieve pyrolysis on the surfaces 9 and 8 (and 10 and 11 as in the first position) of the chamber 1.

In this second position there will again be provided the means for connection to the motor 45 (or to another motor) and the means for cooperation with the arms 31 and 32 of the member 27.

Figure 5:
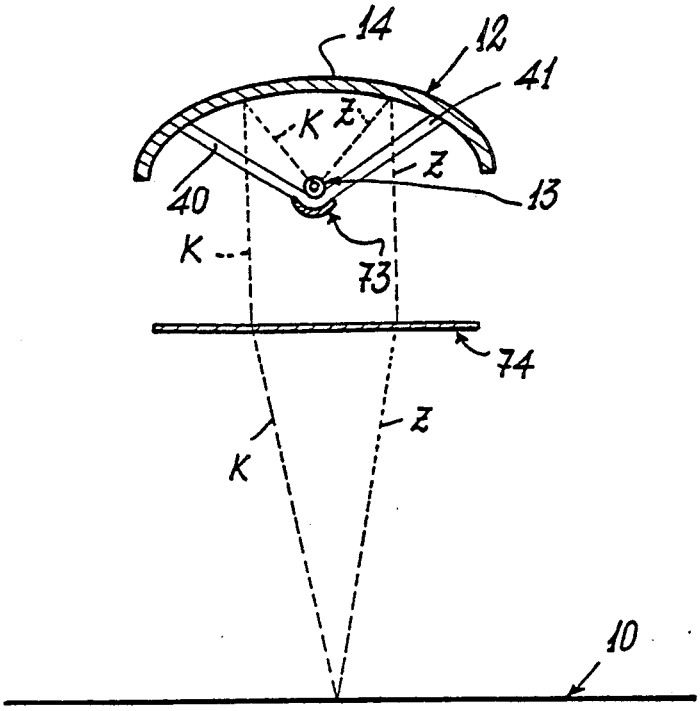

A further embodiment is shown in FIG. 5.

The difference between the embodiment of FIG. 5 and that already described is in the provision of a reflector 73 positioned below the lamp 13 and associated with this later in any known manner, and in the provision of a converting lens 74 positioned below the device 12. The use of the invention as shown in FIG. 5 is similar to that already described and will not be repeated. It should merely be noted that the element 14 generates a light beam of parallel rays which are then converged by the lens 74 to form a "line" of light (or light band) on a surface of the chamber 1.

Figure 6:
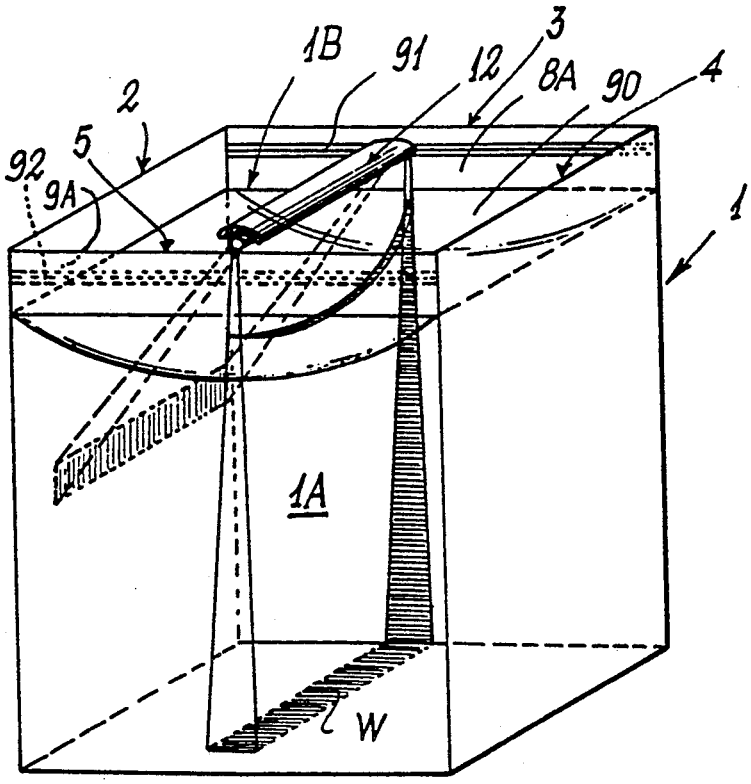
FIG. 6 is a view similar to that of FIG. 1, illustrating a modified embodiment of the oven of that figure, with some parts shown in partial section.

A further embodiment of the invention is shown in FIG. 6.

This oven embodiment has the device 12, constructed in an of the described forms, positioned above a transparent (glass or similar) element 90 of special shape. This element is of concave shape wit hits concavity facing the device 12.

The element 90 defines two compartments within the cooking chamber 1. The food to be processed is placed in a first compartment 1A and the device 12 is placed in a second compartment 1B. This device is mobile with discrete translational movement above the element 90 and is guided in this translational movement by tracks 91 and 92 formed on portions 8A and 9A of the walls 3 and 5 of the chamber 1.

Movement is achieved by known movement means such as a rack and pinion, a belt with drive and return pulley or the like. Because of the particular form of the concave element 90, a single "stepwise" translational movement of the device 12 (which in this case does not comprise the reflector element mobile relative to the lamp 13) a band (or "line") of light is generated over all surfaces of the walls of the cooking chamber, with resultant pyrolysis on all surfaces.

It should be noted that the transparent element 90 of FIG. 6 and the lens 74 of FIG. 5 are constructed of a glass material having high transmittance within the infrared band.

An oven has been described provided with a device 12 which generates a light beam.

However for the purposes of the invention, ie for achieving pyrolysis on the surfaces of the walls of the chamber 1, the device 12 can alternatively use other known means (laser, microwave or other means) to generate heat waves which generate a very high temperature on said surfaces by striking them.

In addition, by combining said device with a voltage or current intensity variator, the device can be used for variable power grilling or for lighting the cooking chamber.

We claim:

1. A food preparation oven comprising a plurality of walls defining a cooking chamber, means for generating heat waves and for directing said heat waves in a concentrated manner onto said walls, said means for generating heat waves being removable arranged in said cooking chamber and being mobile therein and locatable in a plurality of locations so as to direct said heat waves onto the entire surfaces of said walls, said concentrated waves scanning said surfaces creating a high temperature thereon which results in pyrolysis of impurities which have been deposited on said surfaces during use of said oven.

2. An oven as claimed in claim 1, said heat wave generation means including a generator and a reflector element positioned to correspond with said generator.

3. An oven as claimed in claim 1, wherein said heat wave generation means is a halogen lamp.

4. An oven as claimed in claim 2, further including motor means for rotating said reflector element, and wherein said generator and said reflector element are mobile relative to each other, said reflector element being rotatable about said generator.

5. An oven as claimed in claim 4, further including means for connecting said means for generating heat waves to said motor means, wherein said connecting means is provided with a projection which cooperates with a corresponding seat in an output shaft of said motor means.

6. An oven as claimed in claim 4, wherein said motor means comprises an electric motor advantageously of the stepping type able to generate a discrete movement of said heat wave generating means, said heat wave generating means, after every movement, remaining in the position reached for a much longer time period than that through which said movement took place.

7. An oven as claimed in claim 4, further including means for fixing a free end of said heat wave generation means to a roof of said cooking chamber, said fixing means including a pair of arms which project from an end support member, said arms being provided with ends arranged to cooperate with said roof, said arms being elastically mobile relative to each other.

8. An oven as claimed in claim 2, wherein said generator and said reflector element are fixed together and are mobile jointly.

9. An oven as claimed in claim 7, wherein movement of said generator and said reflector element is a rotary movement.

10. An oven as claimed in claim 7, wherein the of said generator and said reflector element is a translational movement.

11. An oven as claimed in claim 9, wherein said transitional movement of said reflector element and said generator takes place in a guided manner within a first compartment of said cooking chamber, said first compartment being defined by a transparent element positioned within said chamber, said transparent element further defining within said chamber a second chamber compartment in which food are processed.

12. An oven as claimed in claim 10, wherein said translational movement of said heat wave generation means takes place along a plurality of guide tracks.

13. An oven as claimed in claim 11, wherein said transparent element has a concave shape with its concavity facing said heat wave generation means and its convexity facing said second compartment in which foods are processed.

14. An oven as claimed in claim 2, further including a reflecting screen positioned a short distance from said generator, said reflecting screen being symmetrical to said reflector element about said generator.

15. An oven as claimed in claim 13, further including a convergent lens positioned adjacent to said heat wave generation means.

16. An oven as claimed in claim 15, wherein said transparent element and said convergent lens are constructed of a glass material with high transmittance within the infrared band.

17. An oven as claimed in claim 3, wherein said halogen lamp further includes a screen positioned within its outer casing.

18. An oven as claimed in claim 2, wherein said reflector element is a paraboloid.

19. An oven as claimed in claim 1, wherein said heat generation means are further usable for food preparation, said heat wave generation means being connectable to a voltage or current intensity variator.

20. An oven as claimed in claim 1, wherein said generated heat waves cover limited portions of said surfaces of said walls of said cooking chamber at any given time.

21. An oven as claimed in claim 3, further including motor means for rotating said reflector element, and wherein said generator and said reflector element are mobile relative to each other, said reflector element being rotatable about said generator.

22. An oven as claimed in claim 3, wherein said generator and said reflector element are fixed together and are mobile jointly.

* * * * *